US005829374A

United States Patent [19]

Hede et al.

[11] Patent Number: 5,829,374

[45] Date of Patent: Nov. 3, 1998

[54] SEWN ATTACHMENT LOOP FOR A FLEXIBLE ROPE, AND PROCESS OF MANUFACTURING THE LOOP

[75] Inventors: Jean Marc Hede, La Tronche; Paul Petzl, Barraux, both of France

[73] Assignee: Zedel, Crolles, France

[21] Appl. No.: 726,478

[22] Filed: Oct. 7, 1996

[30] Foreign Application Priority Data

Oct. 10, 1995 [FR] France ..... 95 12071

[51] Int. Cl.[6] ..... D05B 97/00; D07B 1/14

[52] U.S. Cl. ..... 112/400; 112/475.17; 112/475.08; 482/121

[58] Field of Search ..... 112/400, 407, 112/413, 470.33, 475.01, 475.08, 475.17; 57/200; 482/121

[56] References Cited

U.S. PATENT DOCUMENTS 2,122,526 7/1938 Kattermann ..... 112/413
5,205,803 4/1993 Zemitis ..... 482/121
5,244,280 9/1993 Porter et al. ..... 112/400 X

FOREIGN PATENT DOCUMENTS

A-2565112 12/1985 France .
A-2713097 6/1995 France .

*Primary Examiner*—Peter Nerbun
*Attorney, Agent, or Firm*—Oliff & Berridge, PLC

[57] ABSTRACT

A sewn attachment loop for a flexible rope used for rock-climbing, or working at heights, is formed by a short first portion of rope, securedly affixed to an extended second portion of rope by a seam. The seam presents a dissymmetric structure in the non-taut state allowing a homogeneous distribution of the mechanical stresses in the joining strands when the loop is tensed to the taut state. The stitches situated along the first portion of rope extend in the non-taut state of the rope according to a longitudinal staggering greater than that assigned to the stitches of the second portion of rope, the variation of the staggering of said stitches causing a progressive inclination of the joining strands along the seam.

6 Claims, 4 Drawing Sheets

SEWN ATTACHMENT LOOP FOR A FLEXIBLE ROPE, AND PROCESS OF MANUFACTURING THE LOOP

BACKGROUND OF THE INVENTION

The invention relates to a sewn attachment loop for a dynamic rope having a circular cross-section and a longitudinal elasticity, said loop comprising:

a first portion of rope applied and securedly affixed against a second portion of rope by fixing means with an elongated seam, the length of the first portion being shorter than that of the extended second portion, a plurality of elementary turns of thread to constitute said seam and comprising a succession of stitches joined to one another by joining strands.

Tensing of a flexible rope, notably in the case of the user falling, gives rise to a high tensile force F2 at the level of the extended second portion of rope, said force being greater than that F1 applied to the shorter first portion of rope. Part of the force is taken up by the friction of the rope on the snap-hook between the two portions of rope. The diagram of FIG. 8 illustrates the variation of the elongation according to the force, in which the elongation d2 over the second portion of rope is greater than the elongation d1 over the first portion of rope. This difference of elongation of the two portions of rope results in a non-uniform distribution of the mechanical stresses exerted on the stitches and joining strands when the rope is in the taut state. The breaking strength of an attachment of this kind with a conventional seam is limited.

SUMMARY OF THE INVENTION

A first object of the invention is to improve the mechanical strength of a sewn attachment loop for a flexible rope.

The attachment loop according to the invention is characterized in that the seam presents a dissymmetric structure in the non-taut state, allowing a homogeneous distribution of the mechanical stresses in the joining strands when the loop is tensed to the taut state.

According to an embodiment of the invention, the stitches situated along the first portion of rope extend in the non-taut state of the rope with a longitudinal staggering L1 greater than that L2 assigned to the stitches of the second portion of rope, the variation of the staggering of said stitches causing a progressive inclination of the joining strands along the seam.

According to a second embodiment of the invention, the seam comprises a plurality of series of stitches, each having the same number of stitches, and a variable lateral separating distance from one series to the other, the smallest separating distance being situated close to the loop, and the largest separating distance being positioned close to the end of the first portion of rope.

A second object of the invention relates to implementation of a manufacturing process of the sewn attachment loop.

A progressive seam can be achieved by varying the separating distance between the stitches on the first portion of rope, and keeping the same separating distance for the stitches of the second portion of rope.

Another possibility consists in making a straight seam by using the following stages:

the first portion of rope is compressed in the longitudinal direction during the sewing operation, the separating pitch between the stitches is kept constant over each portion of rope during said operation, releasing the compression force at the end of the sewing operation then causes relaxation of the first portion of rope to obtain said dissymmetric structure in the non-taut state.

BRIEF DESCRIPTION OF THE DRAWINGS

Other advantages and features will become more clearly apparent from the following description of different embodiments of the invention, given as non-restrictive examples only and represented in the accompanying drawings in which.

DETAILED DESCRIPTION OF THE PREFERRED EMBODIMENT

Figure 3:
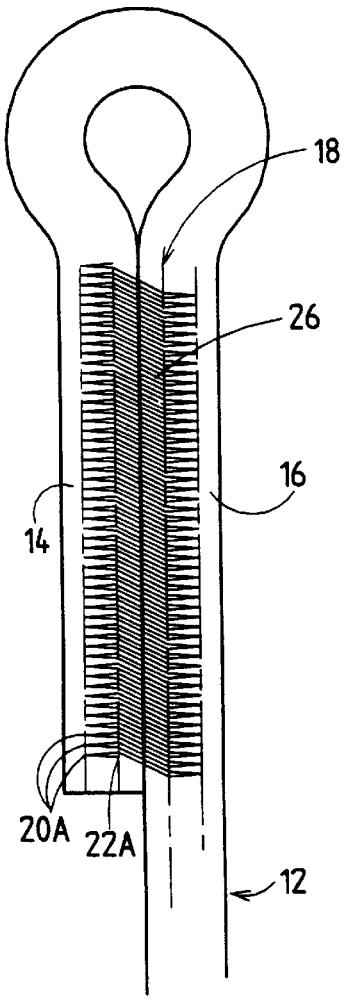
FIGS. 2 and 3 show identical views to FIG. 1, respectively on loading and in the taut state of the rope.

With reference to FIGS. 1 to 4, an attachment loop 10 of a flexible rope 12, notably of circular cross-section, is formed from a first portion of rope 14 applied and securedly affixed against a second portion of rope 16 by an elongated seam 18. The first portion of rope 14 constitutes the terminal part, which is shorter than the extended second portion of rope 16.

The flexible rope 12 has a predetermined longitudinal elasticity, and in case of a tensile force occurring, the component F2 of the tensile force exerted on the extended second portion of rope 16 is greater than the component F1 to which the shorter first portion of rope 14 is subjected. To prevent the harmful effects of an excessive differential elongation between the two adjacent portions of rope 14, 16 in the taut state, the seam 18 is achieved according to a specific longitudinal configuration making use of a progressive distribution of the stitches.

The portion of rope 14 comprises stitches 20A, 22A staggered at regular intervals over a longitudinal distance L1. The other portion of rope 16 is provided with the same number of stitches 20B, 22B staggered over a distance L2. In the non-taut state of the rope, the distance L2 is smaller than the distance L1. The stitches 20A, 22A; 20B, 22B of the seam 18 are joined to one another by joining strands 26, 30 disposed respectively on the upper face and the lower face of the attachment 10.

Figure 1:
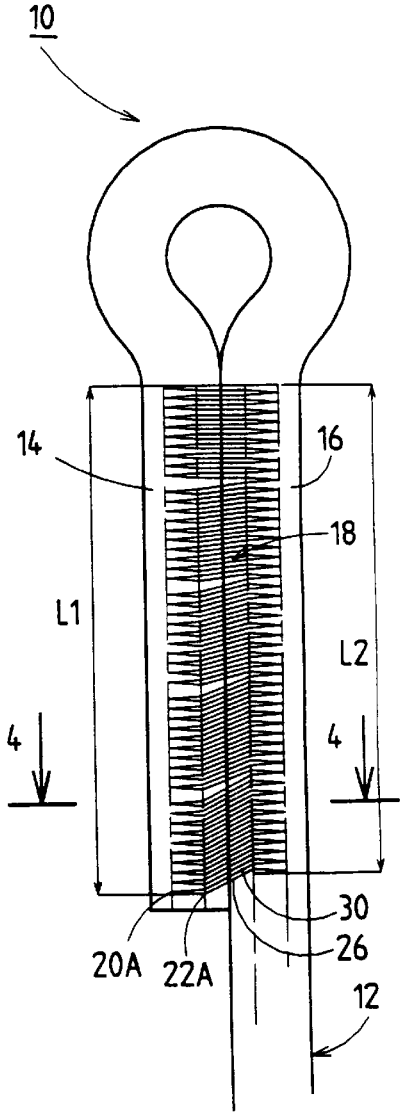
FIG. 1 is a schematic view of a sewn attachment loop according to the invention, the loop being represented in the non-taut rest state.
Figure 4:
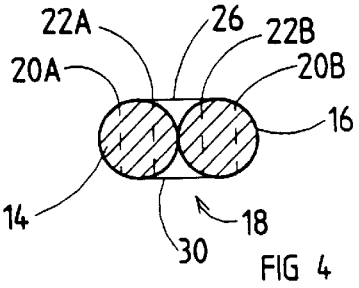
FIG. 4 is a cross-sectional view along the line 4—4 of FIG. 1.

In the non-taut rest state of the seam 18 represented in FIG. 1, the variation of the staggerings L1 and L2 causes a progressive inclination of the joining strands 26, 30 in the direction of the end of the first portion 14.

Figure 2:
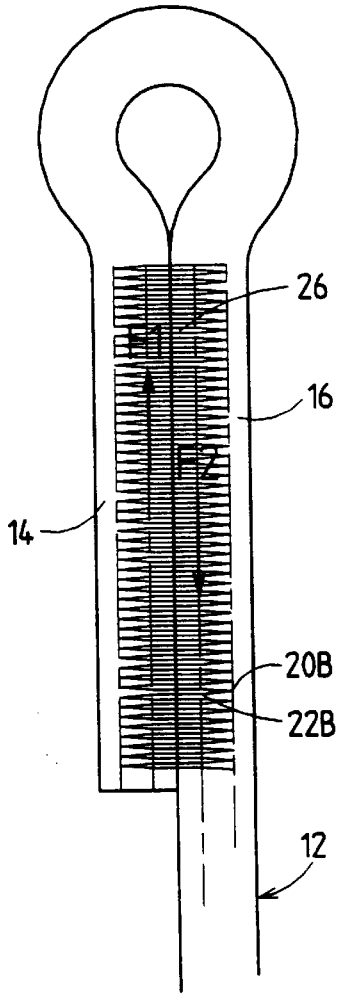

When the rope 12 is subjected to a load due to the action of the tensile force, the second portion of rope 16 of the attachment 10 is elongated more than the first portion of rope 14. In FIG. 2, the stitches 20A, 22A of the first portion 14 are then facing the stitches 20B, 22B of the second portion 16.

Figure 8:
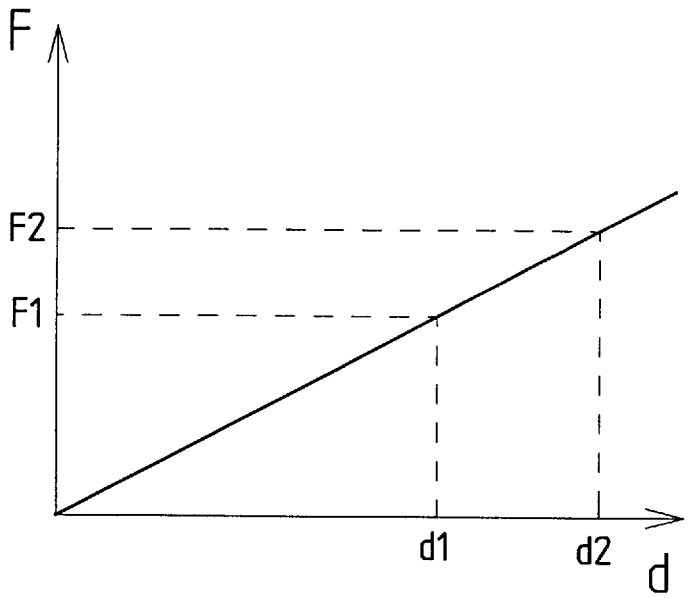
FIG. 8 illustrates the variation of the elongation according to the force for a flexible rope of FIGS. 1 to 3.

In the taut state represented in FIG. 3, the joining strands 26 remain appreciably parallel, so as to obtain a homogeneous distribution of the mechanical stresses in the seam 18 even if the force F2 applied to the second portion of rope 16 is greater than the force F1 on the first portion of rope 14. FIG. 8 illustrates the curves representative of the tensile force according to the elongations of the two sections of rope 14, 16, enabling the same final length L1+d1 and L2+d2 to be obtained for a force F2 greater than F1. The joining strands 26, 30 of the seam 18 are slightly inclined, but remain parallel to one another. The mechanical breaking strength is thus improved, which is particularly advantageous for safety when the attachment loop 10 is used for mountain climbing, notably on an abseiling rope, or a belaying lanyard.

Figure 6:
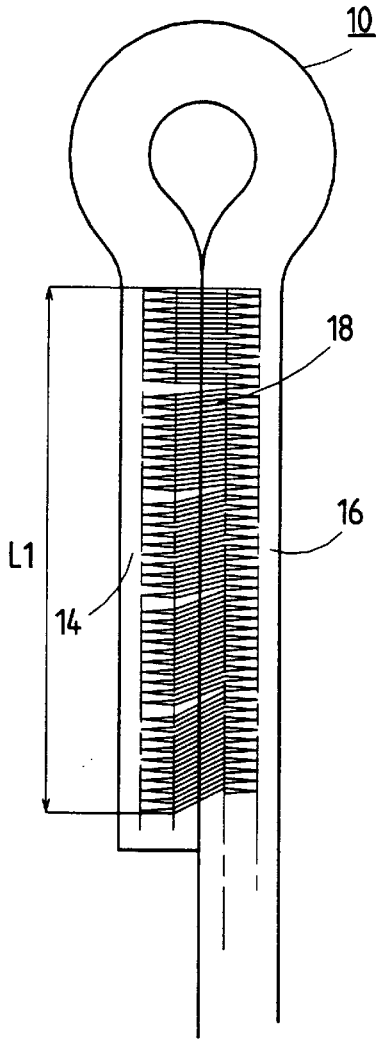
FIG. 6 is an identical view to FIG. 5, after the compressed portion of rope has been relaxed.
Figure 5:
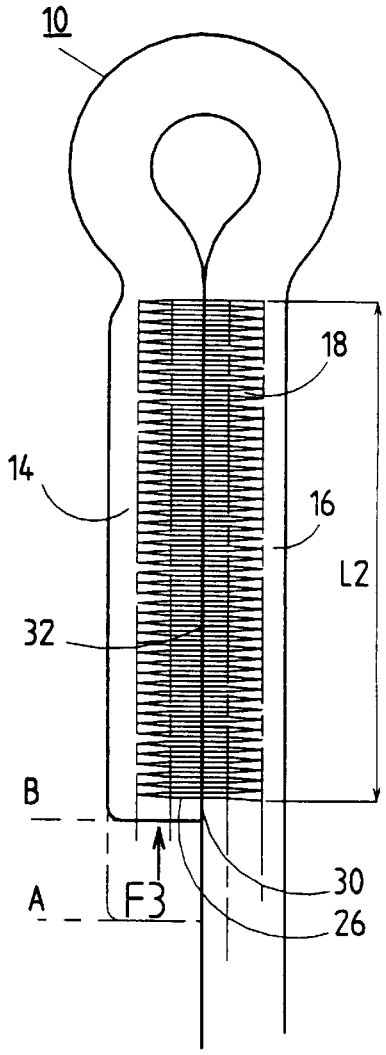
FIG. 5 represents an embodiment of the seam according to the invention, after prior compression of the shorter portion of rope.

Instead of achieving a progressive sewn seam in the case of FIG. 1, it is also possible to make a straight seam 18 (FIG. 5) after prior compression of the first portion of rope 14 in the direction of the arrow F3. The end of the first portion of rope 14 is thus displaced from position A to position B during the sewing operation, in the course of which all the joining strands 26, 30 extend parallel to one another in a direction perpendicular to the longitudinal interface 32 between the two portions of rope 14, 16. All the stitches are staggered at regular intervals over the distance L2. The released rope (FIG. 6) then takes on the arrangement of the evolutive stitches according to FIG. 1.

Figure 7:
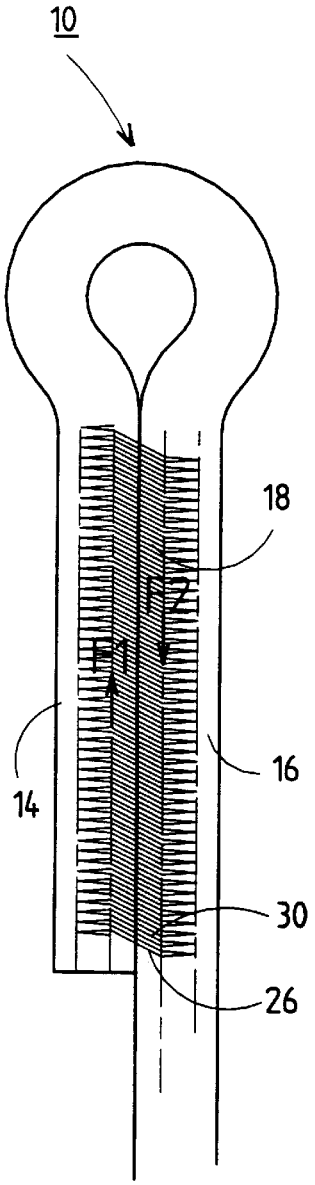
FIG. 7 is an identical view to FIG. 6, in the taut state of the attachment.
Figure 9:
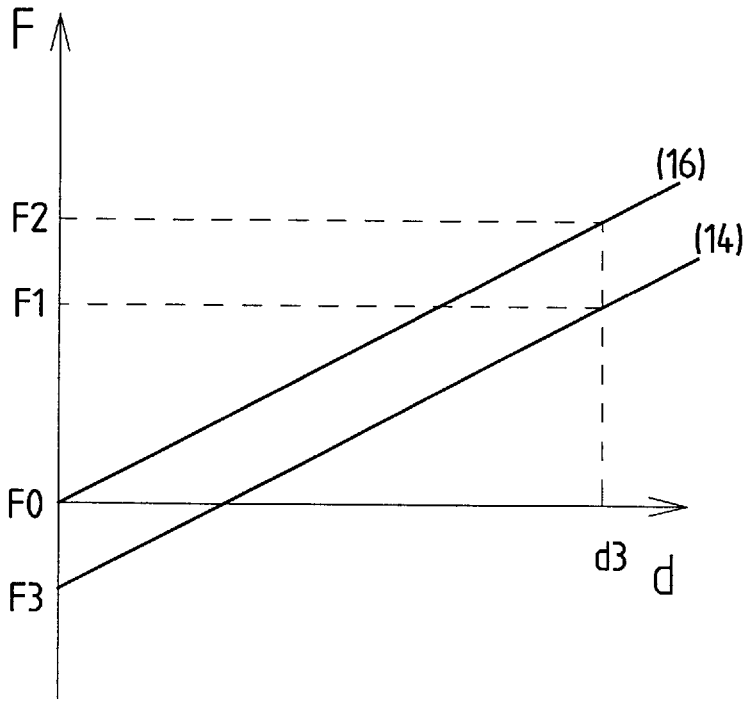
FIG. 9 shows the diagram of the forces according to the elongation of the seam zone for the rope according to FIGS. 5 to 7.

In FIG. 9, the elongation is zero when the seam is manufactured. The first portion 14 is sewn in the compressed state (F3 negative) and the other portion of rope 16 is sewn without any force F0. In the taut state of the rope, the force F2 is greater than F1, but the elongation d3 of the two portions of rope 14, 16 is identical. This results in a homogeneous distribution of the stresses in the inclined and parallel joining strands 26, 30 (FIG. 7).

It is naturally possible to modify the structure of the seam 18 by suitably choosing the number and location of the stitches on each portion of rope 14, 16.

Figure 11:
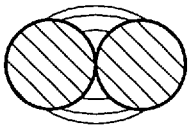
FIG. 11 is a cross-sectional view along the line 11—11 of FIG. 10.
Figure 10:
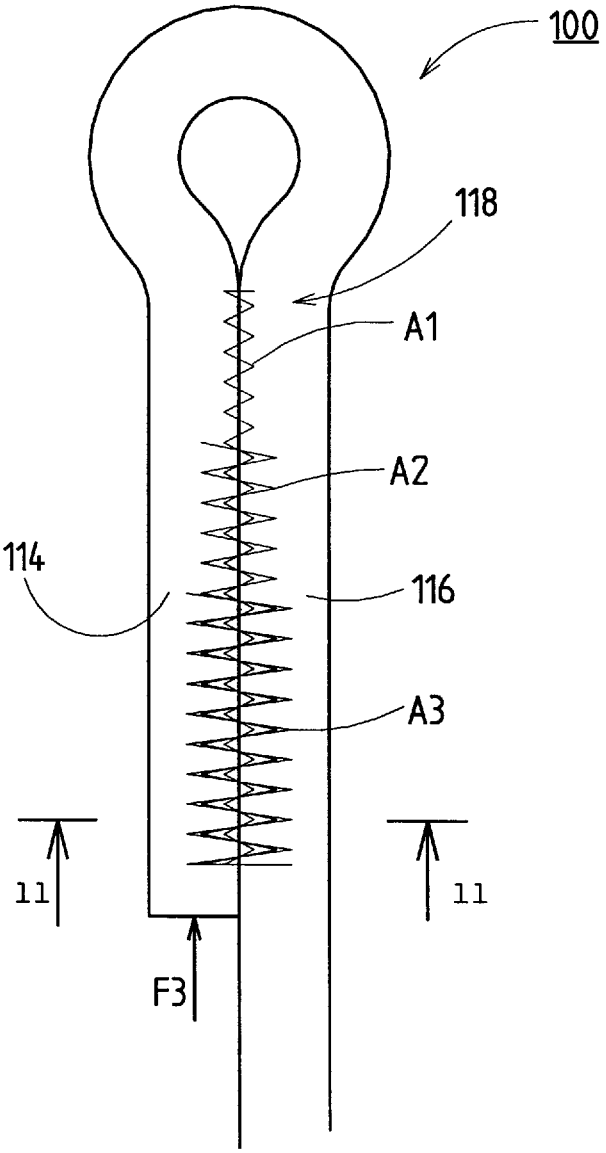
FIG. 10 is an identical view to FIG. 5 of an alternative embodiment.

With reference to FIGS. 10 and 11, the loop 100 comprises a plurality of series A1, A2, A3 of stitches partially superposed between the two sections of rope 114, 116. The difference of elongation of the two sewn portions is the greater the greater the sewn length. The series A1 is the longest for a minimum separation distance of the joining strands. The series A2 is shorter than the series A1, but presents a greater separation distance. The third series A3 is shorter than the series A2, but with a greater separation distance. This dissymmetry between the stitches of the three superposed series thus enables the effective length of the seam to be reduced.

The thread used to achieve the seam 18, 118 is a synthetic fiber based textile thread with a high mechanical strength. The flexible rope 12 is a conventional off-the-shelf belaying rope, used in the field of rock-climbing or of working at great heights to absorb the energy in case of a fall.

According to the seam 18 of FIGS. 1 to 7, the stitches on each portion of rope extend according to lines parallel to the longitudinal interface 32 for adjoinment of the two portions of rope.

We claim:

1. A sewn attachment loop for a flexible rope, notably of circular cross-section, comprising:

a first portion of rope applied and securedly affixed against an extended second portion of rope by fixing means with an elongated seam, the length of the first portion being shorter that of the extended second portion, a plurality of elementary turns of thread to constitute said seam and comprising a succession of stitches joined to one another by joining strands, said seam presenting a dissymmetric structure in a non-taut state allowing a homogeneous distribution of the mechanical stresses in the joining strands when the loop is tensed to a taut state.

2. The attachment loop for a flexible rope according to claim 1, wherein stitches situated along the first portion of rope extend in the non-taut state of the rope with a longitudinal staggering greater than that assigned to stitches of the second portion of rope, the variation of the staggering of said stitches causing a progressive inclination of the joining strands along the seam.

3. The attachment loop for a flexible rope according to claim 2, wherein the stitches on each portion of rope extend according to lines parallel to the longitudinal interface for adjoinment of the two portions of rope.

4. A sewn attachment loop for a flexible rope, notably of circular cross-section, comprising:

a first portion of rope applied and securedly affixed against an extended second portion of rope by fixing means with an elongated seam, the length of the first portion being shorter than that of the extended second portion, a plurality of elementary turns of thread to constitute said seam and comprising a succession of stitches joined to one another by joining strands, said seam presenting a structure in a non-taut state allowing a homogeneous distribution of the mechanical stresses in the joining strands when the loop is tensed to a taut state, wherein the seam comprises a plurality of superposed series of stitches, presenting a variable length and lateral separating distance from one series to the other, the longest first series having a minimum separating distance.

5. A process for manufacturing a loop according to claim 1, comprising:

forming the loop from the flexible rope by securing the first portion of rope to the extended second portion of rope; and sewing the first portion of rope to the extended second portion of rope, with a varying separation distance between stitches on the first portion of rope, and a fixed separating distance for stitches on the second portion of rope.

6. A process for manufacturing a loop according to claim 1, comprising the following steps:

compressing the first portion of rope in the longitudinal direction while sewing the first portion of rope to the extended second portion of rope, keeping the separating pitch between the stitches constant over each portion of rope during said sewing operation, and releasing the compression force at the end of the sewing operation to cause relaxation of the first portion of rope and obtain said dissymmetric structure in the non-taut state.

* * * * *